US008098873B2

(12) United States Patent
Furuya et al.

(10) Patent No.: US 8,098,873 B2
(45) Date of Patent: Jan. 17, 2012

(54) HEADPHONES

(75) Inventors: Okitsugu Furuya, Suginami-ku (JP); Yosuke Sato, Kasukabe (JP); Mitsuo Miyata, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 1342 days.

(21) Appl. No.: 11/653,255

(22) Filed: Jan. 16, 2007

(65) Prior Publication Data

US 2007/0165900 A1 Jul. 19, 2007

(30) Foreign Application Priority Data

Jan. 18, 2006 (JP) ..... 2006-009421

(51) Int. Cl.
*H04R 25/00* (2006.01)

(52) U.S. Cl. ..... 381/374; 381/370; 381/379

(58) Field of Classification Search ..... 381/370–383
See application file for complete search history.

(56) References Cited

U.S. PATENT DOCUMENTS

| | | | | |
|---|---|---|---|---|
| 3,026,524 | A * | 3/1962 | Bixby | 2/6.2 |
| 3,104,398 | A * | 9/1963 | Palmaer | 2/209 |
| 3,461,463 | A * | 8/1969 | Beguin | 2/423 |
| 3,682,268 | A * | 8/1972 | Gorike | 181/129 |
| 3,795,919 | A * | 3/1974 | Aho | 2/423 |
| 5,241,971 | A * | 9/1993 | Lundin | 128/864 |
| 2008/0307562 | A1 * | 12/2008 | Tipp | 2/209 |

* cited by examiner

*Primary Examiner* — Curtis Kuntz
*Assistant Examiner* — Ryan Robinson
(74) *Attorney, Agent, or Firm* — Manabu Kanesaka

(57) ABSTRACT

In headphones in which headphone units are worn on the head via a headband having a predetermined urging force, a substantially constant urging force is always obtained without being influenced by a difference in width and shape of the user's head. In headphones 100 including a headphone unit 200 in which an electroacoustic transducer is incorporated in a housing 210; and a head wearing means (for example, a headband 110) for supporting the headphone unit 200 via a hanger member, the headphone unit 200 being held at the ear position of the head in a state of being urged by the head wearing means, the hanger member is a support frame 120 arranged around the housing 210 of the headphone unit 200, and the headphone unit 200 is supported on the support frame 120 via a plurality of constant force spiral springs 130.

13 Claims, 17 Drawing Sheets

HEADPHONES

TECHNICAL FIELD

The present invention relates to headphones. More particularly, it relates to headphones in which headphone units can be worn with a substantially constant urging force regardless of the difference in width and shape of the user's head.

BACKGROUND ART

FIG. 15 shows headphones 10 of a typical conventional example (FIG. 15A is a front view, and FIG. 15B is a side view). Usually, the headphones 10 have a substantially C-shaped headband 11 arranged along the top of the user's head, and at both ends of the headband 11, a pair of right and left headphone units 13 are supported via hanger members 12.

Each of the headphone units 13 has a housing 13*a* incorporating an electroacoustic transducer, not shown, and on the sound emission surface side of the housing 13*a*, an ear pad 13*b* formed of an elastic material is provided. Each of the hanger members 12 is provided with arms 12*a* formed into inverse Y forked shape as described in, for example, Patent Document 1 (Japanese Patent Application Publication No. H09-182183).

As shown in an enlarged sectional view of FIG. 16, connecting pins 14 are provided coaxially in the end portions of the arms 12*a*. By inserting the connecting pins 14 into engagement holes on the housing 13*a* side, the headphone unit 13 is held on the hanger member 12 so as to be turnable with the rotation axis of the connecting pins 14 being the center.

As the headband 11, an elastic band plate of, for example, a metal is used. The headband 11 is formed substantially into a C shape with a predetermined curvature so that the width between the both ends thereof is narrower than the average head width of the ordinary adult. When the headphones 10 are used, the user opens out the headband 11 in the right and left direction in FIG. 15A, and wears the headphone units 13 by holding them to his/her ears.

Thus, when the headphones 10 are worn, the headband 11 is curvedly deformed so that the radius of curvature thereof increases, by which an urging force (restoring force) is generated in the headband 11 in the direction such that the initial radius of curvature is restored (the direction such that the radius of curvature decreases).

This urging force of the headband 11 is determined by the difference between the initial radius of curvature and the radius of curvature at the time when the headphones are worn and the physical properties such as shape and material of the headband 11. Therefore, the headband 11 is designed so as to give a good sense of wearing to the user having the average head width.

Actually, however, the width of the human head varies considerably. When FIG. 17A shows a person having a narrow head width, FIG. 17B shows a person having an average head width, and FIG. 17C shows a person having a wide head width, it has been known from actual measurement that there is a difference of about ±2 cm with respect to the average head width.

As described before, the headphones 10 are designed so as to give a good sense of wearing to the user by using the person having an average head width shown in FIG. 17B as the reference. In this case, the design standard plane for determining the urging force of the headband 11 is a contact plane 15 of the headphone unit 13 for the head having the average width.

On the other hand, as shown in FIG. 17A, a contact plane 16 of the headphone unit 13 for the person having a head width narrower than the average is narrower than the contact plane 15 shown in FIG. 17B, so that the urging force of the headband 11 at the time when the headphones 10 are worn is weaker than the design value.

Also, as shown in FIG. 17C, a contact plane 17 of the headphone unit 13 for the person having a head width wider than the average is wider than the contact plane 15 shown in FIG. 17B, so that the urging force of the headband 11 at the time when the headphones 10 are worn is weaker than the design value.

In both cases, a good sense of wearing cannot be obtained because of the urging force different from the design value. In addition, in the case where the urging force is weak, the headphone unit 13 is not sufficiently pressed onto the ear, which presents a problem in that sound leakage occurs, and hence the propagation of sound pressure from the headphone unit to the ear is insufficient.

Also, in the case where the urging force is strong, though sound leakage does not occur and hence the propagation of sound pressure from the headphone unit 13 to the ear is sufficient, but long-term wearing sometimes causes a physical pain to the user.

Accordingly, an object of the present invention is to provide headphones in which a substantially constant urging force can always be obtained without being influenced by a difference in width and shape of the user's head.

SUMMARY OF THE INVENTION

To achieve the above object, the present invention provides headphones including a headphone unit in which an electroacoustic transducer is incorporated in a housing; and a head wearing means for supporting the headphone unit via a hanger member, the headphone unit being held at the ear position of the head in a state of being urged by the head wearing means, wherein the hanger member consists of a support frame arranged around the housing of the headphone unit, and the headphone unit is supported on the support frame via a plurality of constant force spiral springs.

According to a preferred mode of the present invention, the constant force spiral springs are arranged at equal intervals. Also, the winding base end portion side of the constant force spiral spring is attached to the support frame via a radial bearing. Also, the constant force spiral spring has a winding base end portion attached to the support frame at both ends thereof, and an intermediate portion thereof is arranged along the diameter line of the housing.

As another mode, the winding base end portion of the constant force spiral spring may be attached to the support frame side, and the end portion on the pull-out side thereof may be fixed to the housing side. Inversely, the winding base end portion of the constant force spiral spring may be attached to the housing side, and the end portion on the pull-out side thereof may be fixed to the support frame side. Also, the support frame preferably consists of a support ring arranged concentrically with the housing to properly achieve the characteristic of the constant force spiral spring.

The constant force spiral spring is one kind of flat springs formed by tightly winding a strip-shaped spring sheet material in a spiral form, and has a characteristic such that when the free end side thereof is pulled out in a state in which the constant force spiral spring is wound on a cylindrical shaft forming a center axis and the base end portion thereof is attached rotatably, a pull-out force that is constant regardless of the pull-out amount (constant force) is shown from the time when the pull-out amount exceeds a certain initial value.

In the present invention, since the headphone unit is supported by the constant force spiral springs having the aforementioned characteristic, there can be obtained an urging force that gives a good sense of wearing regardless of the width of the user's head and even if there is a difference in angle of the ear and the head.

DETAILED DESCRIPTION

Figure 1:
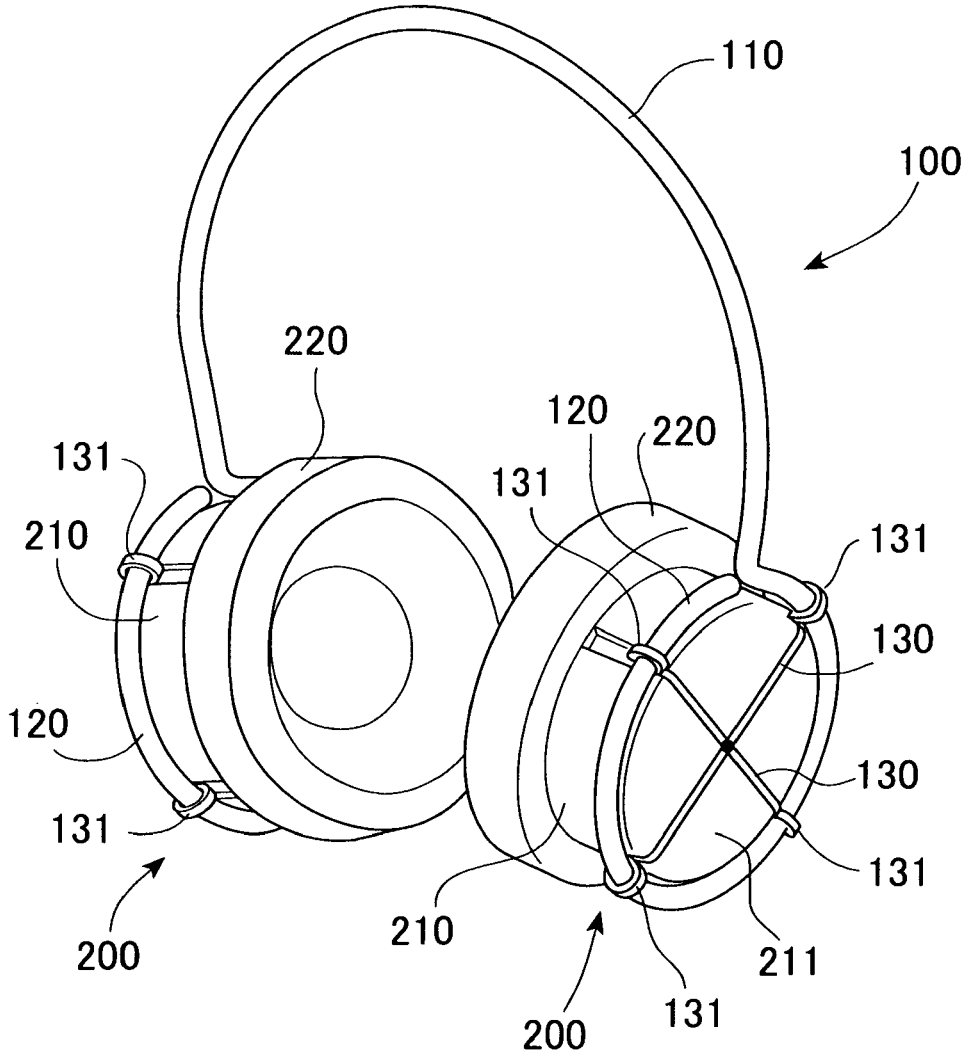
FIG. 1 is a perspective view showing one example of headphones in accordance with the present invention.
Figure 2:
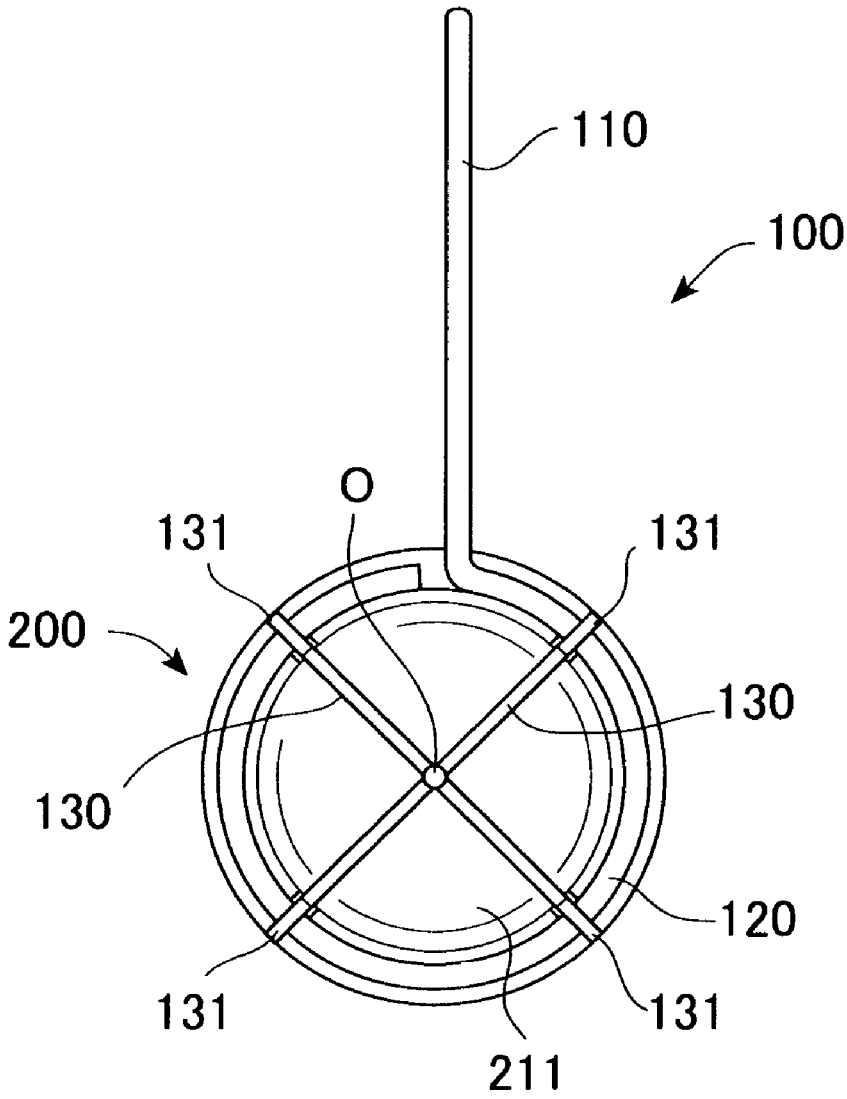
FIG. 2 is a side view of FIG. 1.
Figure 3:
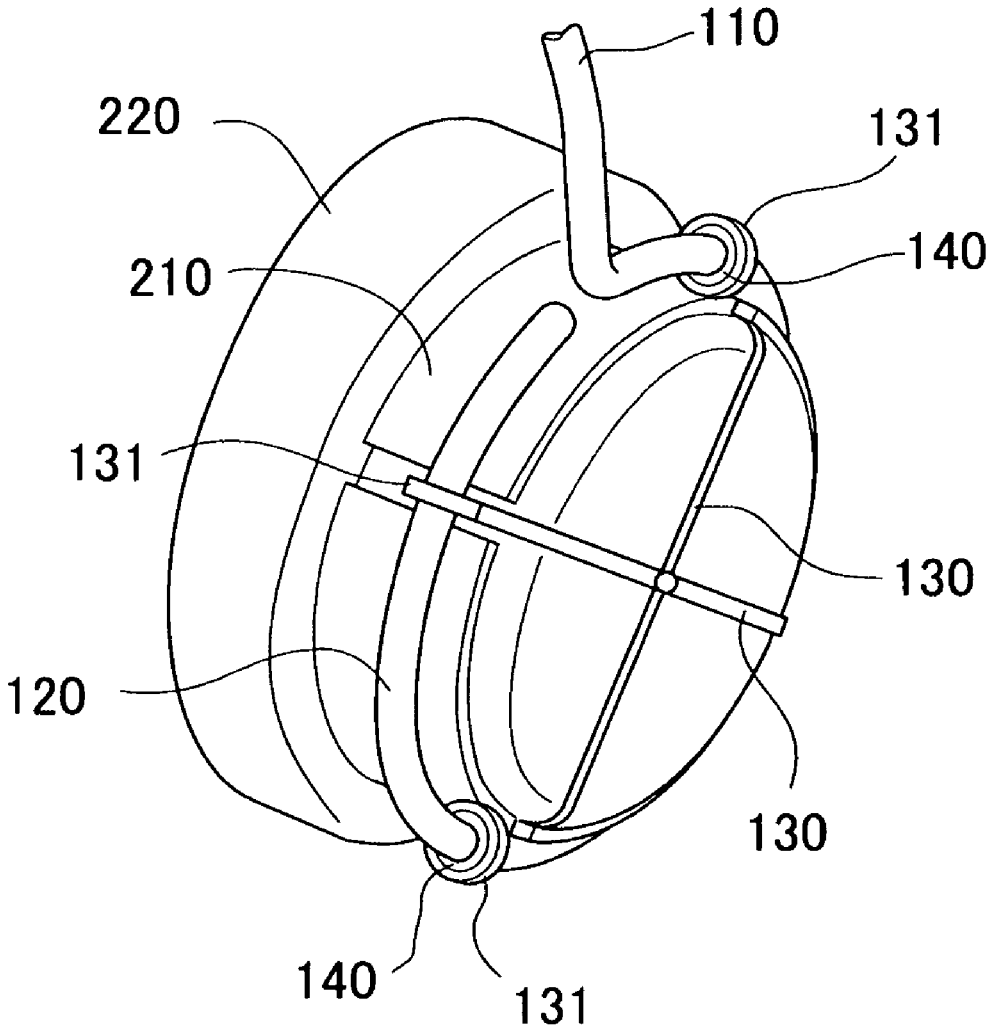
FIG. 3 is an enlarged perspective view of a portion of one headphone unit.

An embodiment of the present invention will now be described with reference to FIGS. 1 to 14. The present invention is not limited to this embodiment.

In FIGS. 1 to 4, headphones 100 explained in this embodiment have a headband (head wearing means) 110 formed substantially into C shape with a predetermined curvature so as to be arranged along the top of the user's head. At both ends of the headband 110, there are provided support frames (hanger members) 120 that support a pair of right and left headphone units 200.

In this example, the headband 110 and the support frames 120 are formed integrally by one metallic round bar. However, the headband 110 and the support frames 120 may have a separated configuration: the support frame 120 may be turnably connected to the headband 110, for example, via a universal coupling. Also, an elastic band plate made of a metal or synthetic resin may be used for the headband 110. In some cases, the headband 110 may have a rigid configuration having no elasticity.

In any case, the headband 110 is designed considering the radius of curvature and material thereof and further the construction so that a proper urging force is exerted with the average head width being used as the reference. The headband 110 can also be designed so as to be arranged in the back of the user's head.

The headphone 200 has a bottomed cylindrical housing 210 incorporating an electroacoustic transducer, not shown, and on the sound emission surface side of the housing 210, an ear pad 220 formed of, for example, a sponge material is provided.

The support frame 120 is arranged around the housing 210 of the headphone unit 200. In this example, since the housing 210 is cylindrical, the support frame 120 is also formed into a circular ring shape. However, the support frame 120 need not necessarily be a complete ring-shaped body the entire periphery of which is connected. The support frame 120 may have a polygonal ring shape such as a square or a hexagon, but is preferably arranged concentrically with the housing 210.

Figure 4:
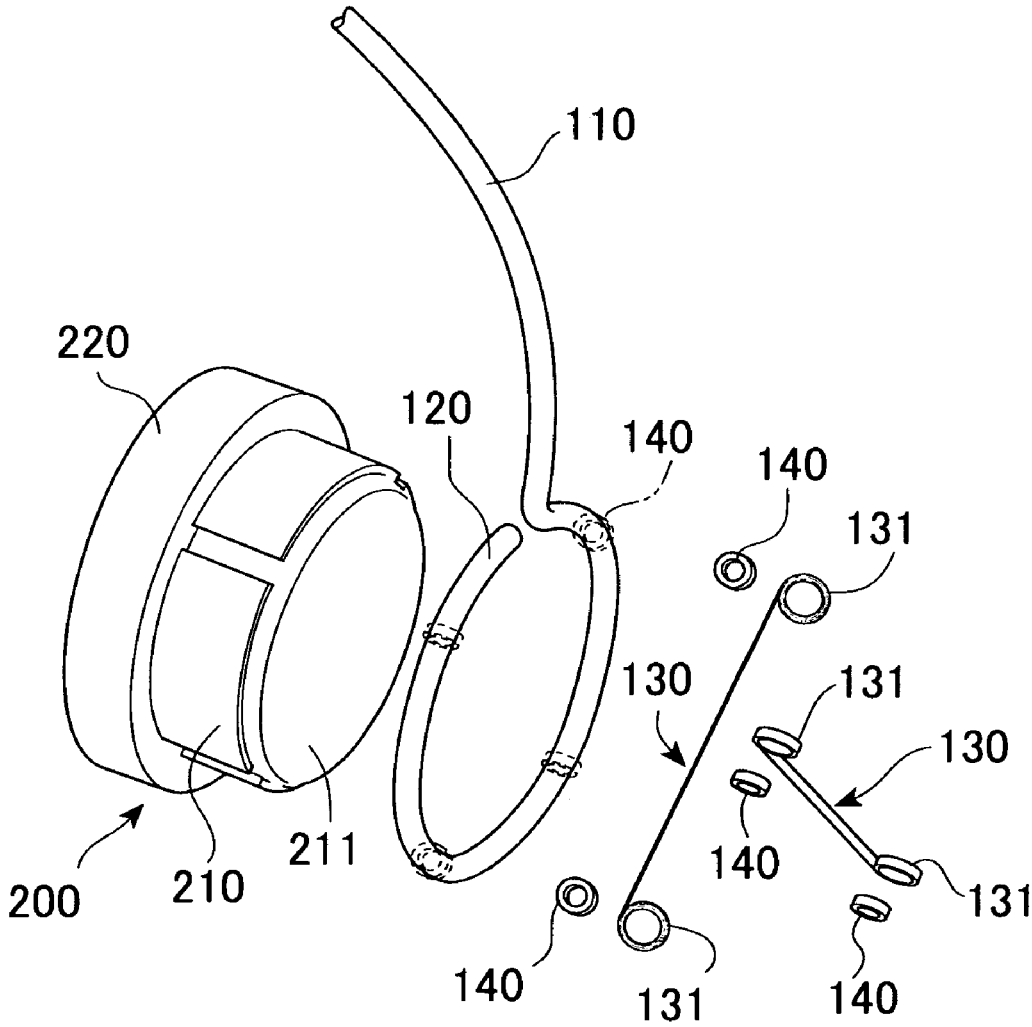
FIG. 4 is an exploded perspective view of FIG. 3.

According to the present invention, the headphone unit 200 is supported on the support frame 120 via constant force spiral springs 130. As shown in FIG. 4, the constant force spiral spring 130 in this example is a constant force spiral spring having winding base end portions 131 at both ends. In this example, two constant force spiral springs 130 are used.

The winding base end portions 131 of each of the two constant force spiral springs 130 are attached rotatably to the support frame 120. At this time, it is preferable that intermediate portions 132 of the constant force spiral springs 130 be caused to intersect with each other in a cross form, and the intersecting portion be fixed to a back surface 211 of the housing 210 with an adhesive, a machine screw, or the like so as to be located at a central position O of the back surface 211 of the housing 210.

Thus, the portion in which the constant force spiral spring 130 is fixed to the housing 210 is limited to the back surface 211, by which the headphone unit 200 can move on the inside of the support frame 120 while swaying freely according to the urging force of the headband 110 and/or the constant force spiral spring 130. To support the headphone unit 200 uniformly, the constant force spiral springs 130 are preferably arranged at equal intervals.

As described above, each of the winding base end portions 131 is attached rotatably to the support frame 120. In this example, to make the rotation of the winding base end portion 131 smooth, a bearing (radial bearing) 140 is interposed between the winding base end portion 131 and the support frame 120.

Figure 5A:
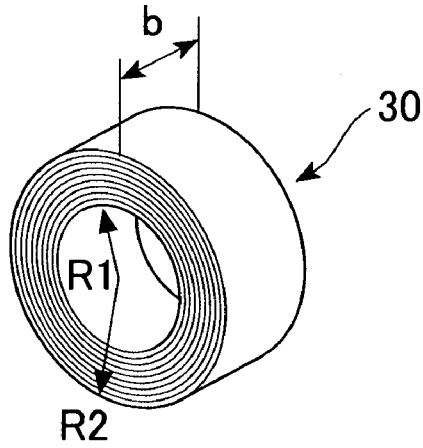
FIGS. 5A and 5B are perspective views showing a basic mode of a constant force spiral spring.

Next, the basic mode and characteristic of the constant force spiral spring 130 are explained with reference to FIGS. 5 to 7. As shown in FIG. 5A, a constant force spiral spring 30 is one kind of thin plate spring formed by tightly winding a spring plate material in a spiral form and by being subjected to hardening etc.

Figure 5B:
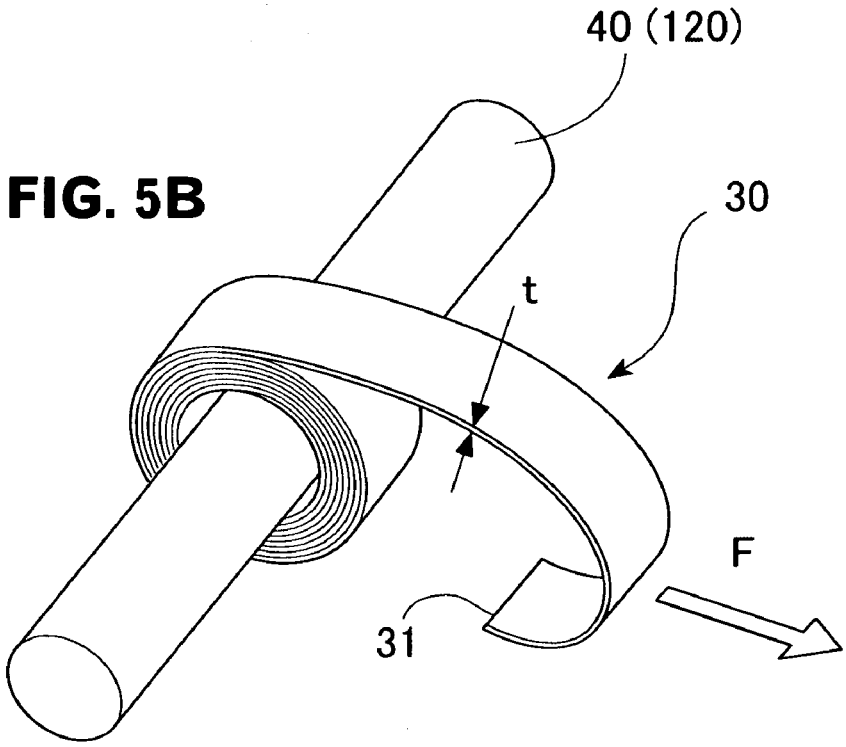
Figures 6A, 6B, 6C, 6D, 6E:
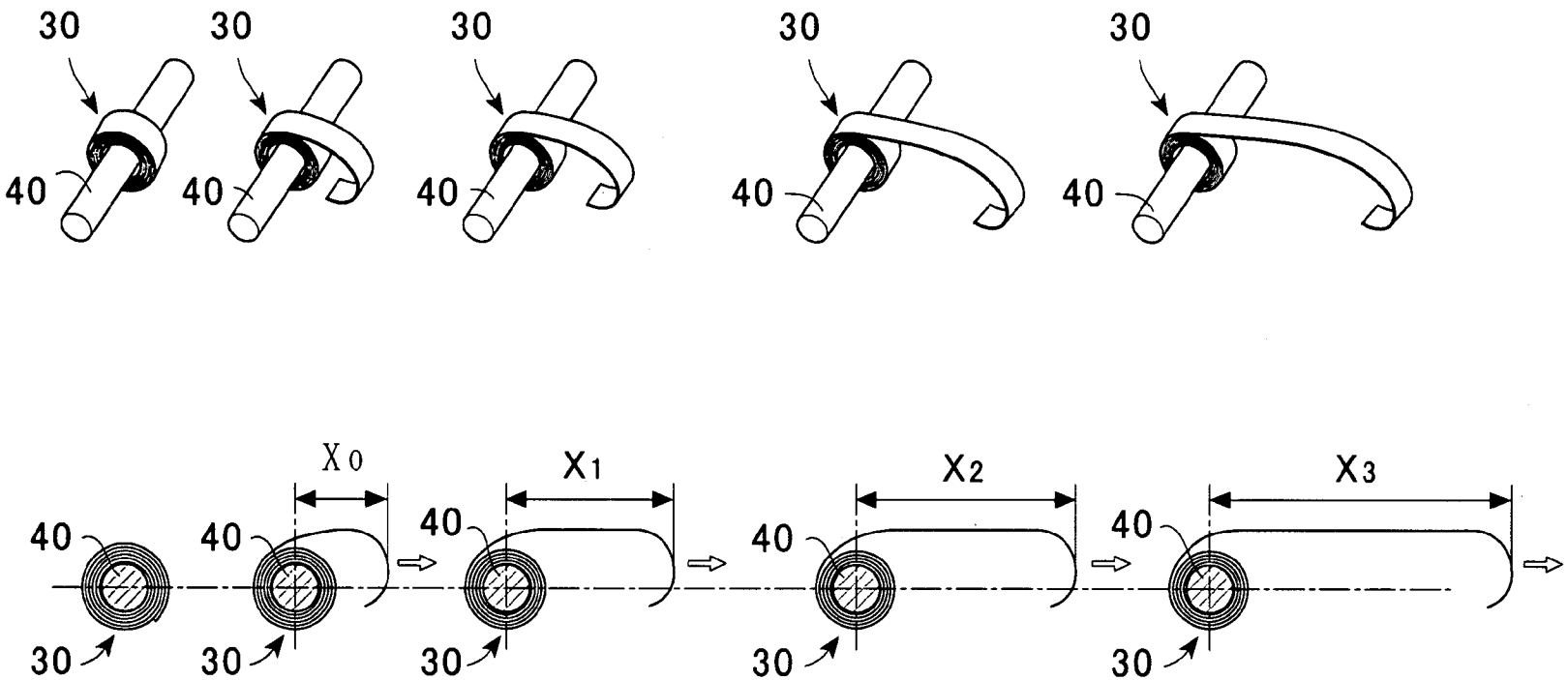
FIGS. 6A to 6E are explanatory views showing a pull-out amount of a constant force spiral spring.
Figure 7:
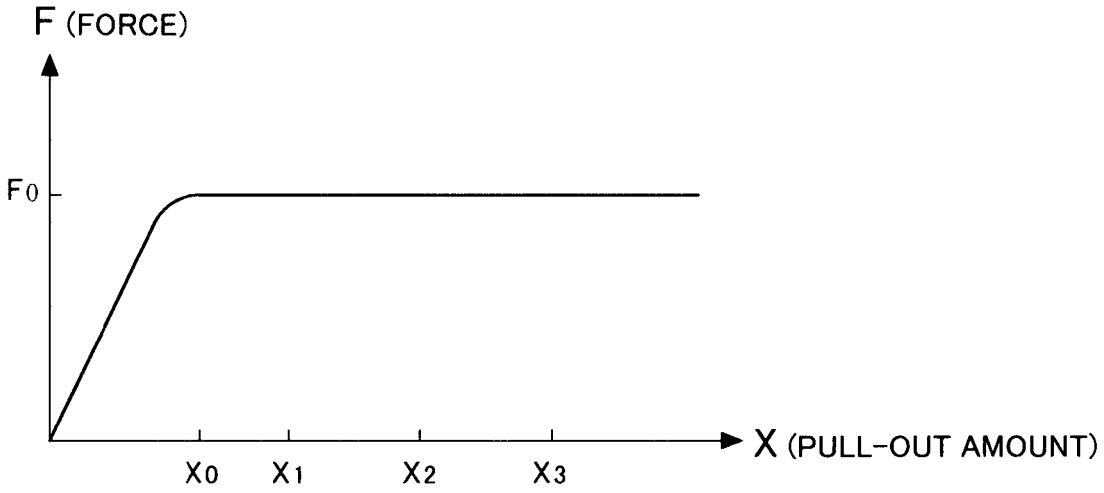
FIG. 7 is a graph showing the characteristic of a constant force spiral spring.

As shown in FIG. 5B, a cylindrical shaft 40 forming a center axis (corresponding to the support frame 120) is inserted through a central hole of the constant force spiral spring 30, and the free end 31 side of the constant force spiral spring 30 is pulled out as shown in FIGS. 6A to 6E while the constant force spiral spring 30 is rotated. At this time, the relationship as shown in a graph of FIG. 7 exists between a pull-out amount X and a pull-out force F.

That is to say, after the pull-out amount X has exceeded a certain initial value $X_0$, the relationship such that the force F is equal to a constant value $F_0$ regardless of the pull-out amount X exists as long as the spring is present. Referring additionally to FIG. 7, FIG. 6B shows a state in which the pull-out amount is $X_0$, and at that time, the force F has reached the constant value $F_0$. FIGS. 6C to 6E show states in which the pull-out amount increases successively to $X_1$, $X_2$, and $X_3$. In these cases as well, the force F remains the constant force $F_0$.

The constant force value $F_0$ of the constant force spiral spring 30 and the value of pull-out amount $X_0$ that can provide the constant force value $F_0$ are determined by the material used and the shape of constant force spiral spring 30, namely, the thickness t, the width b, the inside diameter $R_1$, and the outside diameter $R_2$ shown in FIGS. 5A and 5B, and the modulus of longitudinal elasticity, which is a physical property, of the material.

Figure 8A:
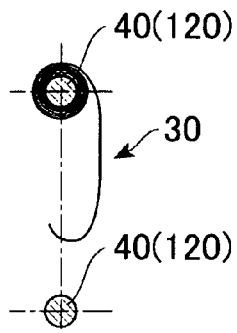
FIGS. 8A to 8F are explanatory views for illustrating the operation of a constant force spiral spring which the headphones shown in FIG. 1 have.

The constant force spiral spring 130 used in the above-described embodiment is a constant force spiral spring of a mode in which, as shown in FIG. 8A, one constant force spiral spring 30 shown in FIG. 5 is wound on two cylindrical shafts 40 (two locations on the diameter line of the support frame 120).

Figure 8B:
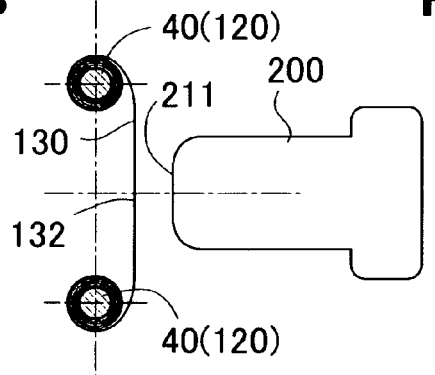

As shown in FIG. 8B, when an object (herein, the headphone unit 200) is pressed against the intermediate portion 132 of the constant force spiral spring 130, a force $F_a$ shows almost the same characteristic as that in the case where the free end 31 of the constant force spiral spring 30 is pulled out as explained before with reference to the graph of FIG. 7. This characteristic is shown in a graph of FIG. 9.

Figure 8C:
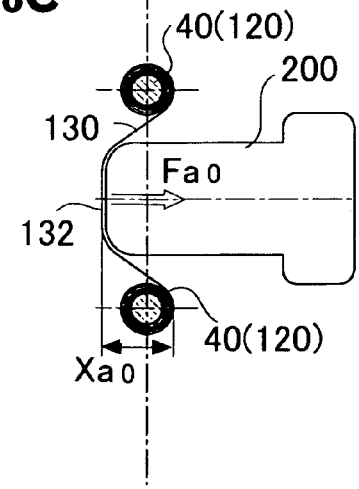
Figure 8D:
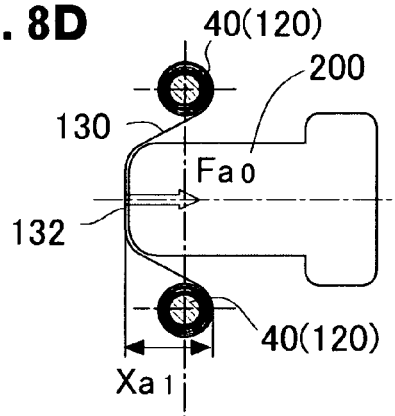
Figure 8E:
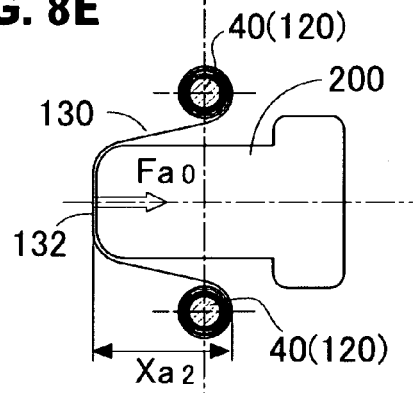
Figure 8F:
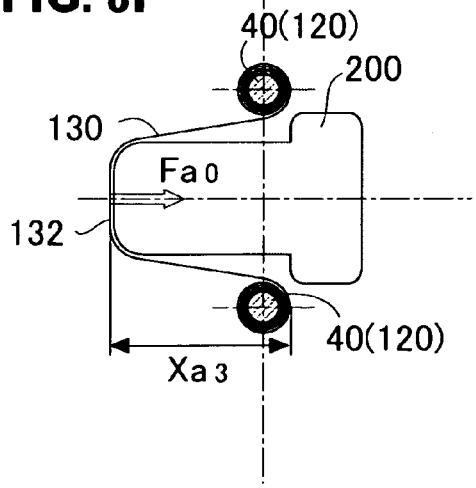
Figure 9:
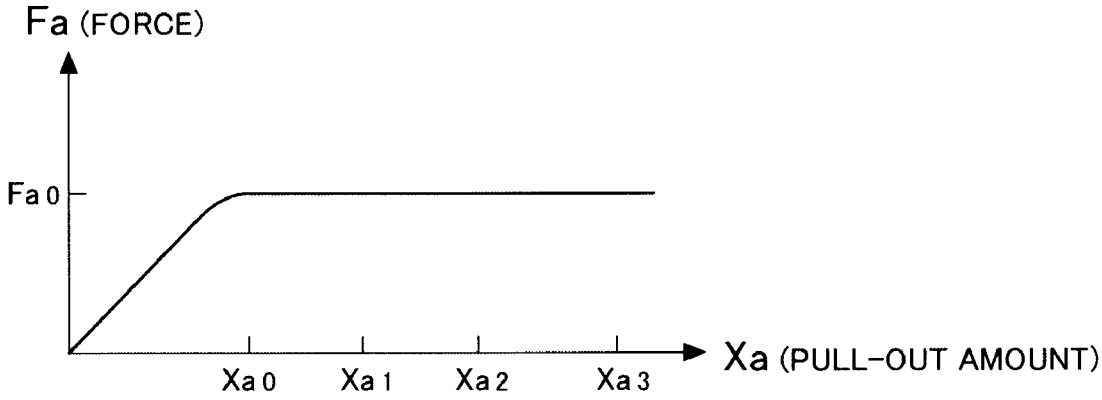
FIG. 9 is a graph showing the characteristic of a constant force spiral spring which the headphones shown in FIG. 1 have.

That is to say, when the pull-out amount is $X_{a0}$ as shown in FIG. 8C, the force $F_a$ reaches a constant force value $F_{a0}$, and thereafter even if the headphone unit 200 is pushed in to increase the pull-out amount to $X_{a1}$, $X_{a2}$, and $X_{a3}$ as shown in FIGS. 8D to 8F, the constant force value $F_{a0}$ is maintained as shown in FIG. 9.

Figure 10A:
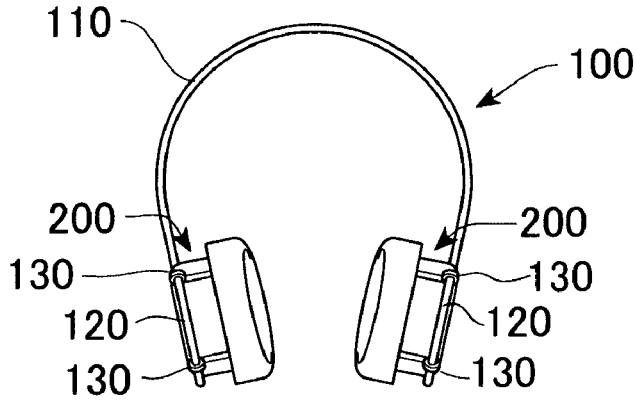
FIG. 10A is a front view showing a state in which headphones in accordance with the present invention are out of use.
Figure 10B:
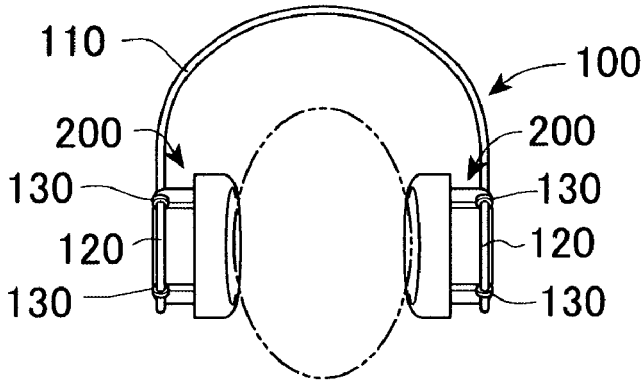
FIGS. 10B to 10D are front views showing wearing examples of headphones in accordance with the present invention.
Figure 10C:
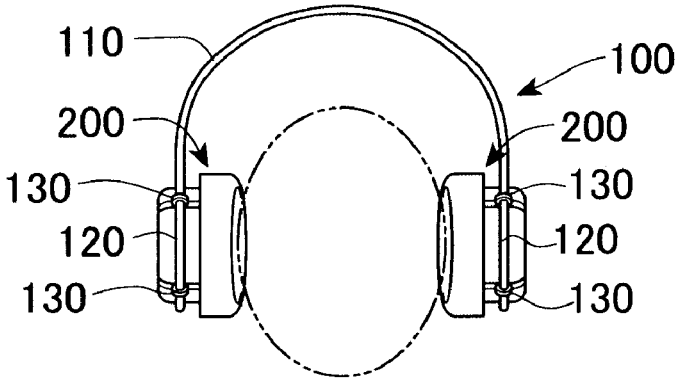
Figure 10D:
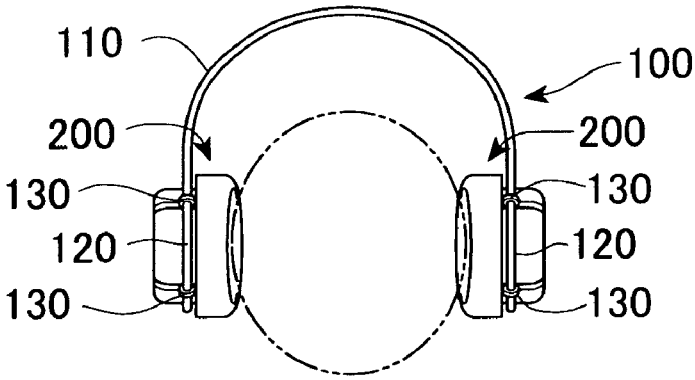

FIGS. 10A to 10D are schematic views of the headphones 100 viewed from the front, and FIG. 10A shows the state in which the headphones 100 are out of use. FIG. 10C shows an example in which the user having an average head width wears the headphone, FIG. 10B shows an example in which the user having a head width narrower than the average wears the headphone, and FIG. 10D shows an example in which the user having a head width wider than the average wears the headphone.

According to FIGS. 10A to 10D, it is found that the opening width of the headband 110 is almost constant regardless of the head width, whereas the pull-out amount of the constant force spiral spring 130 is different according to the head width. That is to say, the constant force spiral spring 130 operates as a buffer.

Figures 11A, 11B, 11C, 11D:
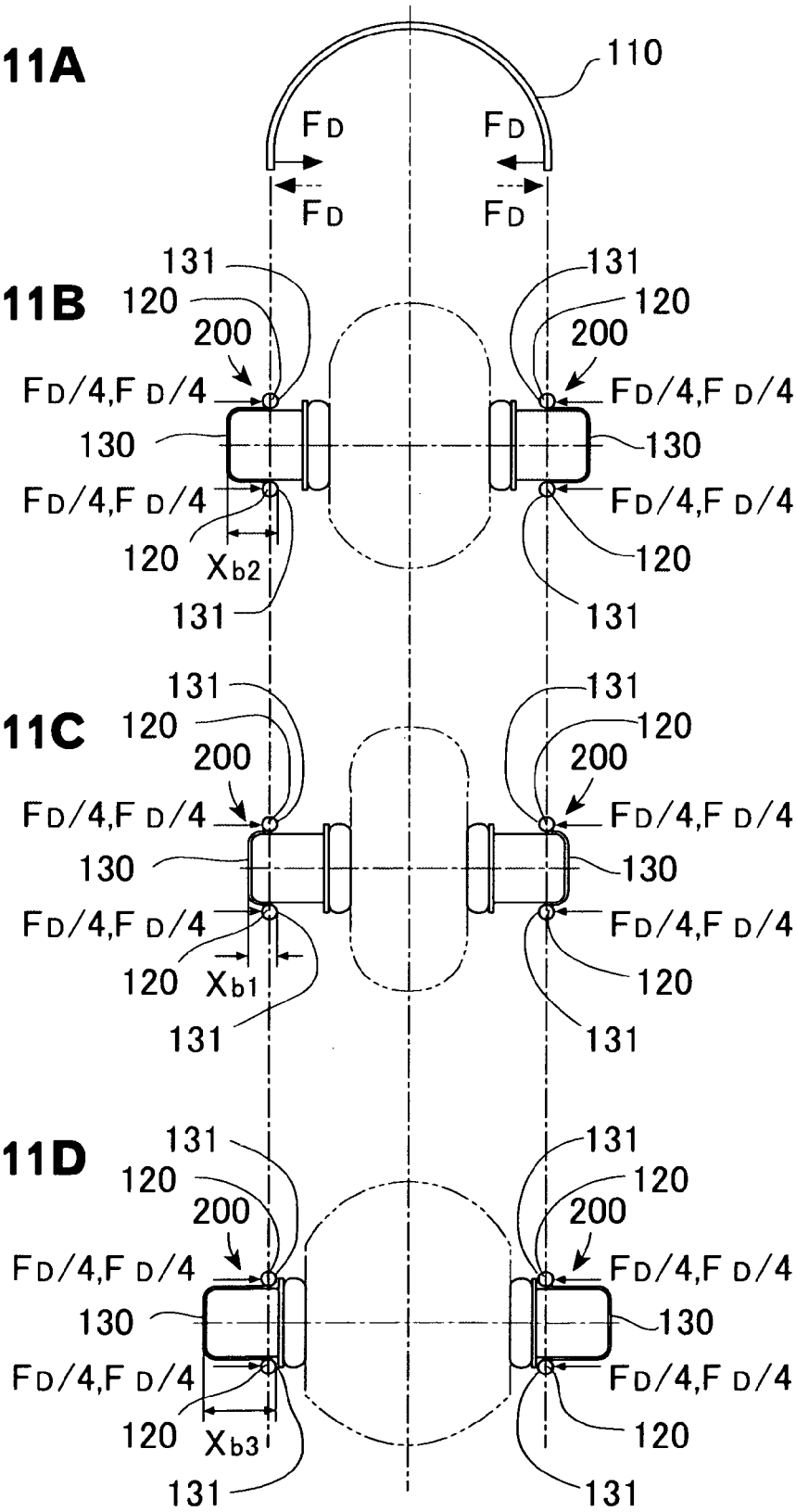
FIGS. 11A to 11D are explanatory views for illustrating the operation of the present invention.
Figure 12:
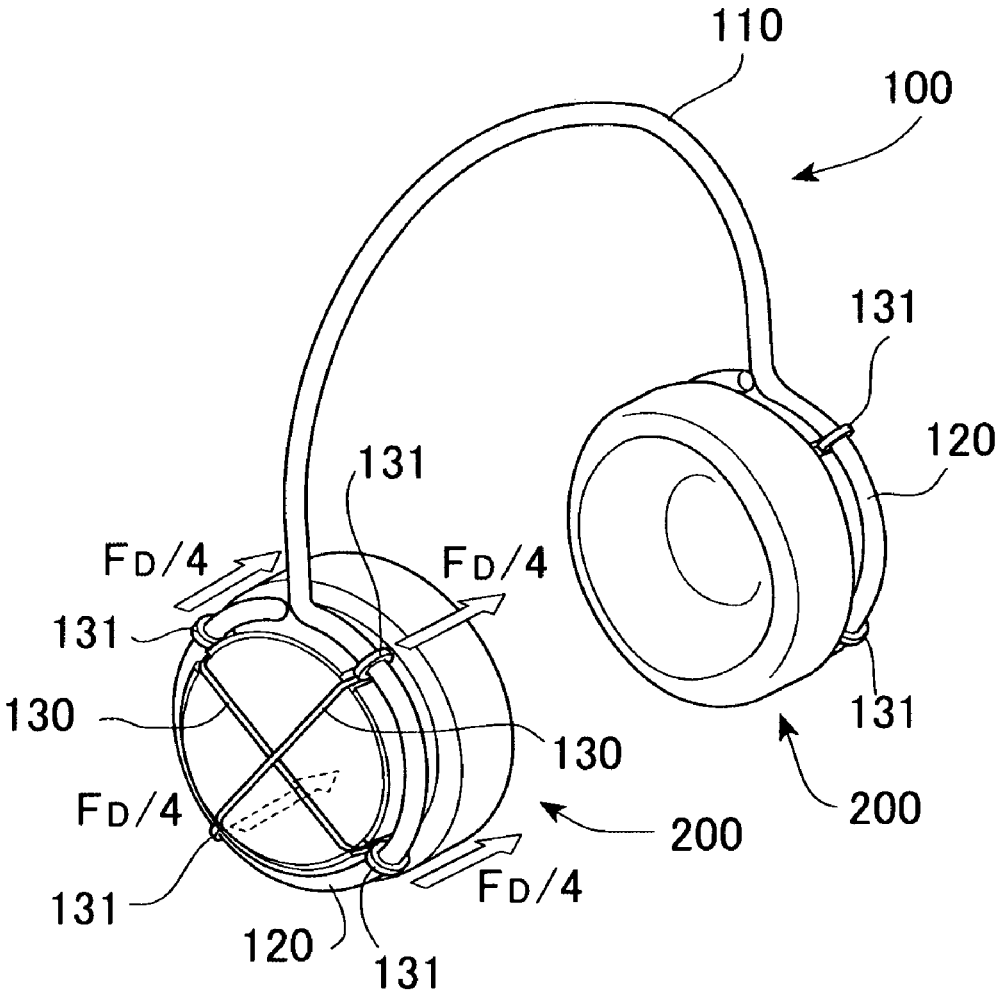
FIG. 12 is a perspective view for explaining the force point of headphones in accordance with the present invention.
Figure 13:
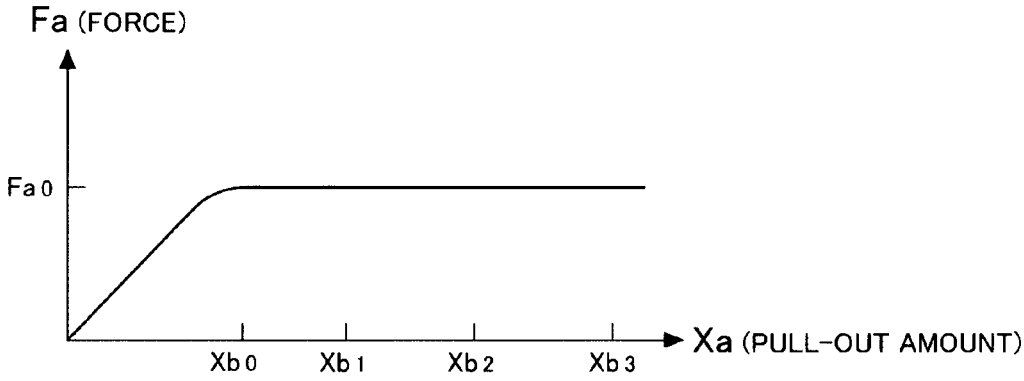
FIG. 13 is a graph showing the characteristic of a constant force spiral spring shown in FIG. 12.

The operation of the constant force spiral spring 130 is explained with reference to FIGS. 11 to 13. As shown in FIG. 11A, the set urging force of the headband 110 is designed so as to be optimal for the person having the average head width, and this set urging force is denoted by $F_D$.

This set urging force $F_D$ is applied to the side of the user's head via the constant force spiral springs 130. In this example, each of the constant force spiral springs 130 has four force points (portions of four bearings 140, or portions of winding base end portions 131 when the bearings are not used). Therefore, as shown in FIG. 12, an urging force of $F_D/4$ is applied from the constant force spiral spring 130 to the side of the user's head through these force points.

As shown in FIG. 11B, the pull-out amount of each of the constant force spiral springs 130 at the time when the user has an average head width is denoted by $X_{b2}$. When the user has a head width narrower than the average, as shown in FIG. 11C, the headphone unit 200 is positioned on the inside as compared with the case shown in FIG. 11B. Therefore, the pull-out amount of the constant force spiral spring 130 becomes $X_{b1}$ smaller than $X_{b2}$.

Also, when the user has a head width wider than the average, as shown in FIG. 11D, the headphone unit 200 is positioned on the outside as compared with the case shown in FIG. 11B. Therefore, the pull-out amount of the constant force spiral spring 130 becomes $X_{b3}$ larger than $X_{b2}$.

In the present invention, the constant force spiral spring is designed so that the set urging force $F_D$ is applied to the housing back surface 211 of the headphone unit 200 in any case. Specifically, the constant force spiral spring 130 is designed so as to produce the constant force value $F_D/2$ in any case of the pull-out amounts of $X_{b1}$, $X_{b2}$, and $X_{b3}$ as shown in a graph of FIG. 13.

According to the above-described embodiment, in any case of FIGS. 11B to 11D, the set urging force $F_D$ is applied to the housing back surface 211 of the headphone unit 200. Therefore, the opening width of the headband 110 is also maintained in an almost constant equilibrium state as shown in FIG. 1A regardless of the head width.

The shapes of the ears and heads of the headphone users are different. Therefore, even if the desired set urging force can be given to the headphone unit 200, unless the headphone 200 comes into contact along the shape of the ears and head of the user, a good sense of wearing cannot be given.

According to the headphones 100 in accordance with the present invention, as described above, the headphone unit 200 is supported swayably on the support frame 120 via the plurality of constant force spiral springs 130. Therefore, the difference in the shape of the ears and head inherent in the user is absorbed, and thereby the desired set urging force can be given to the headphone unit 200. One example thereof is explained with reference to FIG. 14.

Figure 14A:
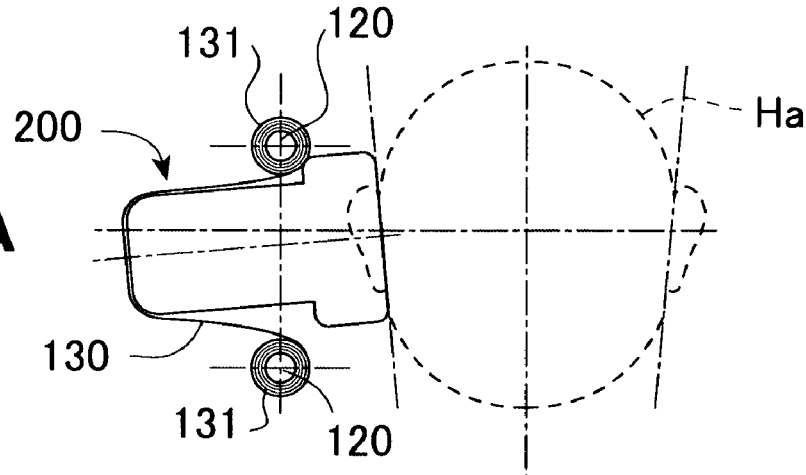
FIGS. 14A to 14C are schematic views showing examples in which the users having different head angles wear headphones in accordance with the present invention.
Figure 14B:
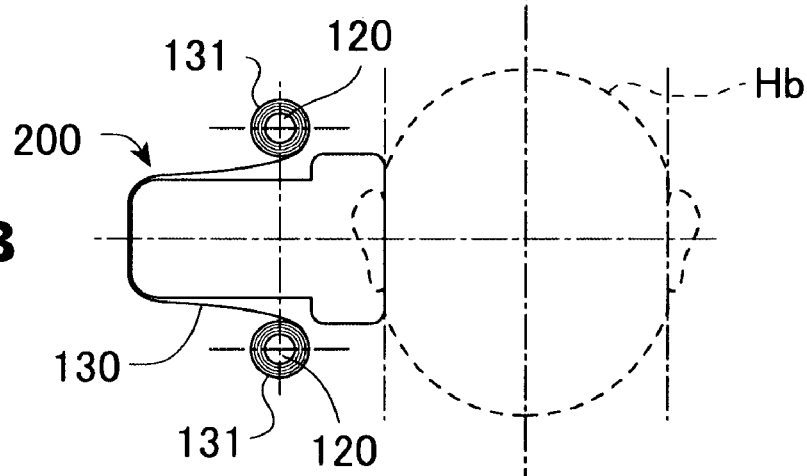
Figure 14C:
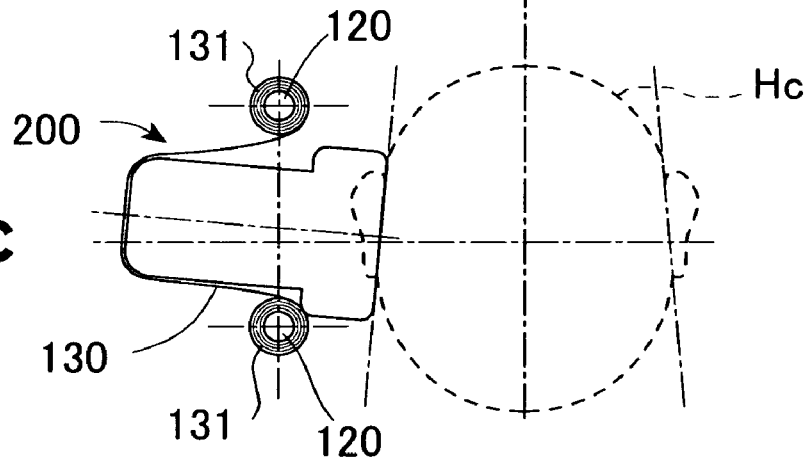
Figure 15A:
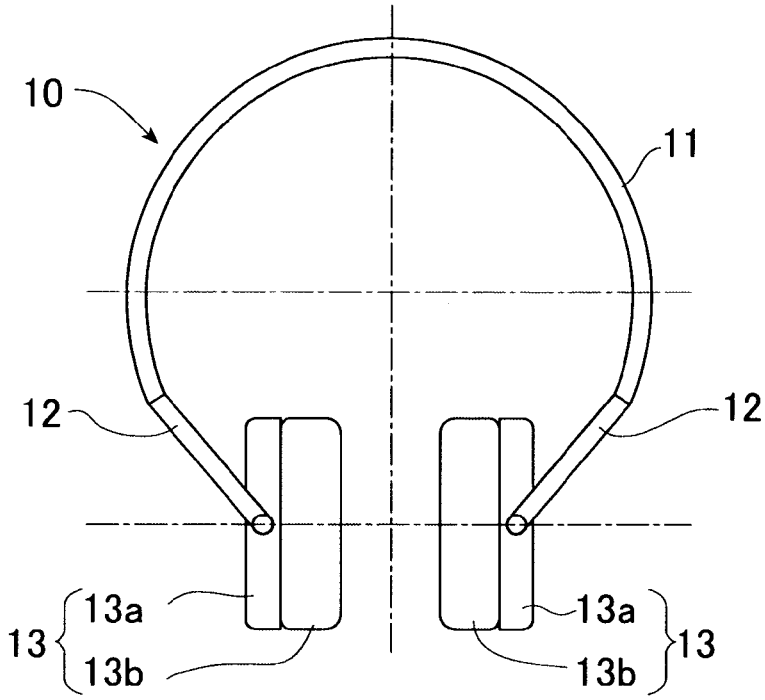
FIG. 15A is a front view schematically showing conventional headphones.
Figure 15B:
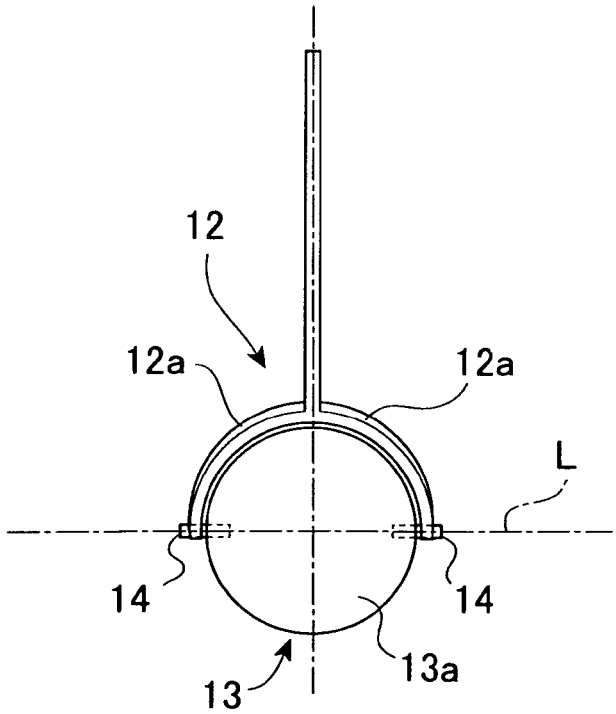
FIG. 15B is a side view of FIG. 15A.
Figure 16:
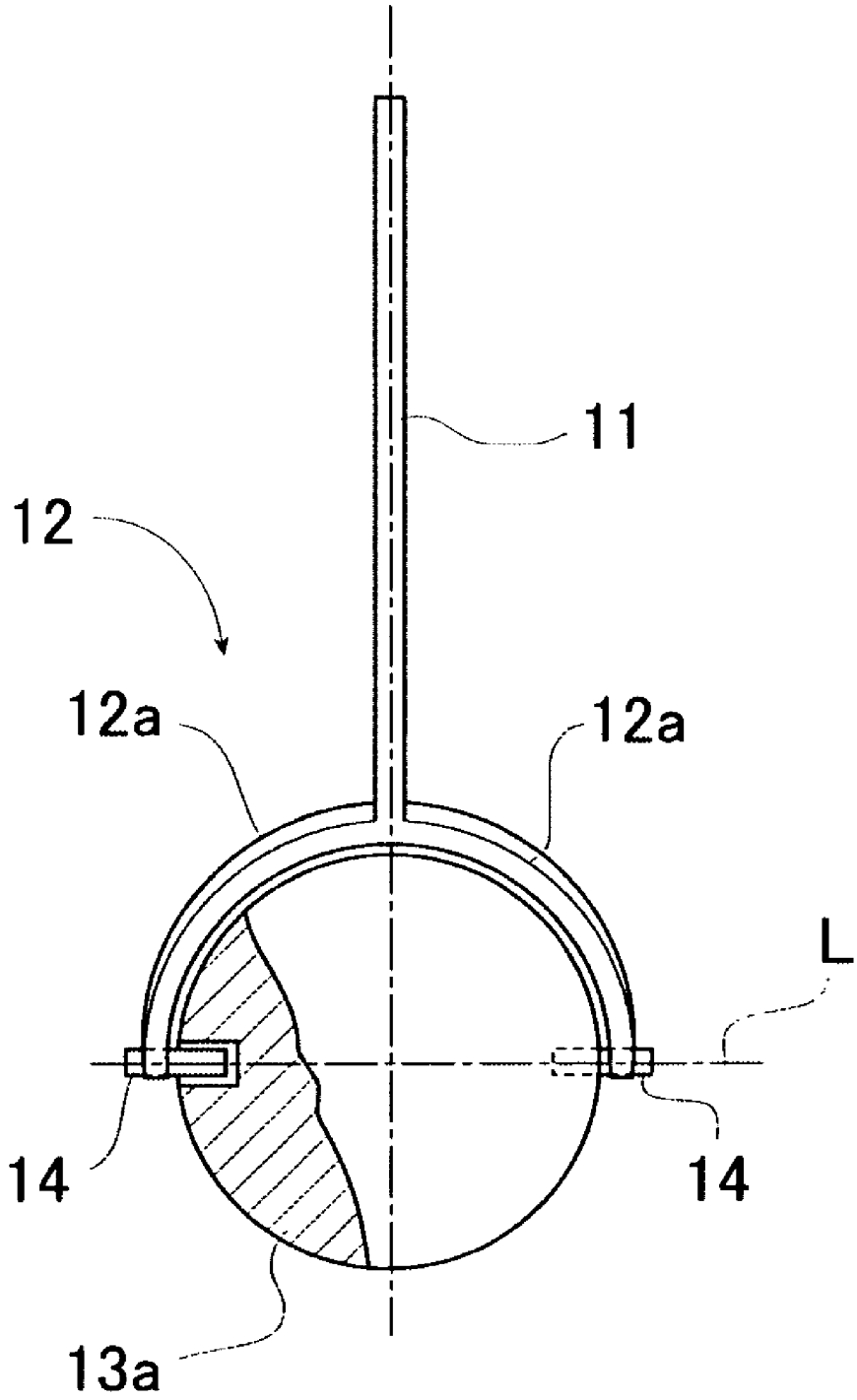
FIG. 16 is an enlarged sectional view showing a headphone unit supporting portion of conventional headphones.
Figure 17A:
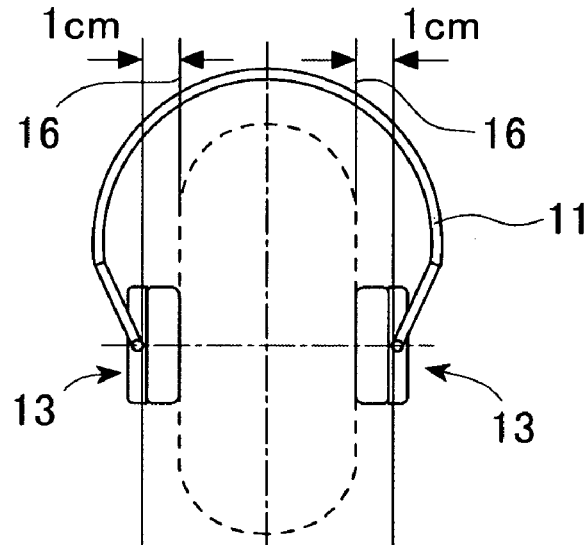
FIGS. 17A to 17C are schematic views showing examples in which the users having different head widths wear conventional headphones.
Figure 17B:
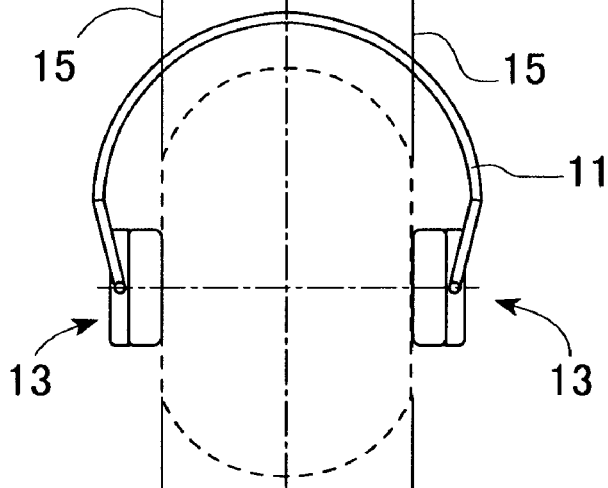
Figure 17C:
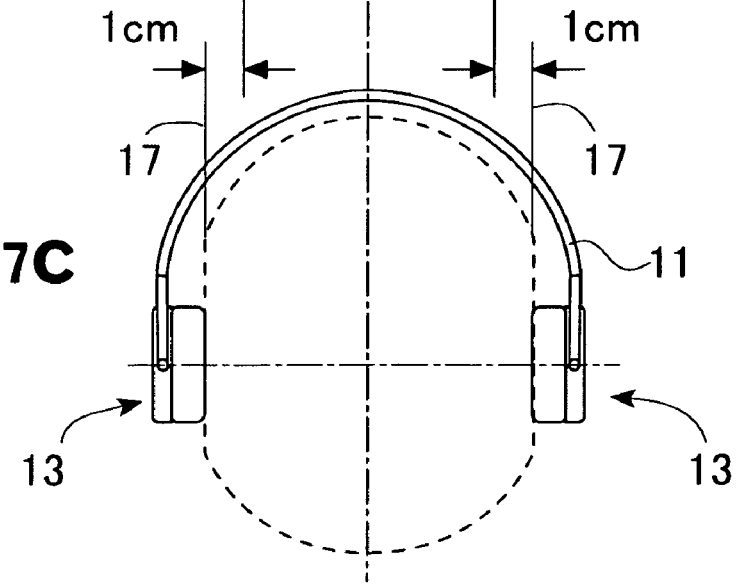

FIGS. 14A to 14C are schematic views showing a state in which the headphone unit 200 is brought into contact with the heads having different shapes (all of three are front views). FIG. 14B shows an example in which the headphone unit 200 is worn on a head Hb the side of which is substantially vertical. In this case, since the constant force spiral spring 130 is pulled out symmetrically with respect to the horizontal plane, the headphone unit 200 comes into contact with the side of the head substantially vertically, and thereby the desired set urging force can be given.

FIG. 14A shows an example in which the headphone unit 200 is worn on a head Ha the side of which has an inverted triangular shape. In this case, since the upper side of the constant force spiral spring 130 is pulled out more than the lower side thereof corresponding to the inclination of the side of the head, the headphone unit 200 comes substantially vertically into contact with the side of the head inclining in the inverted triangular shape.

FIG. 14C shows an example in which the headphone unit 200 is worn on a head Hc the side of which has a substantially triangular shape (what is called a rice ball shape). In this case, since the lower side of the constant force spiral spring 130 is pulled out more than the upper side thereof corresponding to the inclination of the side of the head, the headphone unit 200 comes substantially vertically into contact with the side of the head inclining in the triangular shape.

Even if the constant force spiral spring 130 is pulled out asymmetrically with respect to the horizontal plane as shown in FIGS. 14A and 14C, the desired set urging force is exerted because of the characteristic of constant force spiral spring. In the case where the side of the head inclines in the front and rear direction, too, the headphones 100 in accordance with the present invention can absorb the difference in shape in the same way as described above.

The above is an explanation of the present invention given by taking the embodiment shown in the figures as an example. The present invention is not limited to the above-described embodiment. In the above-described embodiment, two constant force spiral springs 130 having the winding base end portions 131 at both ends are used. However, one or more than two constant force spiral springs 130 may be used.

Also, the configuration may be such that in place of the constant force spiral spring 130 having the winding base end portions 131 at both ends, the constant force spiral spring 30 shown in FIG. 5 is disposed between the support frame 120 and the headphone unit 200. In this case, at least two, preferably three or more, constant force spiral springs 30 are used, and are preferably arranged at equal intervals around the housing 210 of the headphone unit 200.

In this case, the assembling method may be such that the base end portion of the constant force spiral spring 30 is attached to the support frame 120, and the free end 31 on the pull-out side is fixed to the housing 210 side of the headphone unit 200. Alternatively, the assembling method may be such that, inversely, a cylindrical shaft is provided on the housing 210 side of the headphone unit 200, and the winding base end portion of the constant force spiral spring 30 is attached to the cylindrical shaft, by which the free end 31 side is fixed to the support frame 120.

The present invention can also be applied to a headset that mounts a headphone unit and a microphone on the head via a headband. Also, the headphones in accordance with the present invention include headphones in which the headphone unit is supported on only one side of the headband.

The present invention can be used, besides the headphones, for an ear protector used, for example, at the time of shooting practice, and an ear protector using a constant force spiral spring is also embraced in the present invention as an equivalent.

The present application is based on, and claims priority from, Japanese Application Serial Number JP2006-009421, filed Jan. 18, 2006, the disclosure of which is hereby incorporated by reference herein in its entirety.

The invention claimed is:

1. Headphones, comprising:

a headphone unit in which an electroacoustic transducer is incorporated in a housing; and a head wearing means for supporting the headphone unit via a hanger member, the headphone unit being adapted to be held at an ear position of a head in a state of being urged by the head wearing means, wherein the hanger member comprises a support frame arranged around the housing of the headphone unit, and the headphone unit is supported on the support frame via a plurality of constant force spiral springs, and wherein free end sides of the plurality of constant force spiral springs are pulled out when the headphone unit is pushed laterally away from the support frame, and a pull-out force applied to the plurality of constant force spiral spring is constant when an amount of pull-out exceeds a predetermined value regardless of the amount of pull-out.

2. The headphones according to claim 1, wherein the constant force spiral springs are arranged at equal intervals.

3. The headphones according to claim 1, wherein a winding base end portion side of the constant force spiral spring is attached rotatably to the support frame via a radial bearing.

4. The headphones according to claim 1, wherein the constant force spiral spring has a winding base end portion attached rotatably to the support frame at both ends thereof, and an intermediate portion thereof is arranged along a diameter line of the housing.

5. The headphones according to claim 1, wherein a winding base end portion of the constant force spiral spring is attached to a support frame side, and an end portion on a pull-out side thereof is fixed to a housing side.

6. The headphones according to claim 1, wherein a winding base end portion of the constant force spiral spring is attached to a housing side, and an end portion on a pull-out side thereof is fixed to a support frame side.

7. The headphones according to claim 1, wherein the support frame consists of a support ring arranged concentrically with the housing.

8. A headphone, comprising:

a head wearing device including a head band adapted to be worn on a head of a wearer, and a hanger member attached to the head band and having a support frame;

a headphone unit including a housing attached to the support frame of the hanger member, and an electroacoustic transducer incorporated in the housing; and at least one constant force spiral spring for attaching the headphone unit to the support frame, said at least one constant force spiral spring having two free end sides wound around the support frame, and a middle area extending through a center area of the support frame and fixed to the housing of the headphone unit, wherein the free end sides of the constant force spiral spring are pulled out when the headphone unit is pushed laterally away from the support frame, and a pull-out force applied to the constant force spiral spring is constant when an amount of pull-out exceeds a predetermined value regardless of the amount of pull-out.

9. The headphone according to claim 8, wherein a plurality of constant force spiral springs is attached to the support frame to cross each other so that the housing is attached to the plurality of constant force spiral springs.

10. The headphone according to claim 8, wherein the constant force spiral spring has an initial pull amount and a succeeding pull amount after the initial pull amount, and also has characteristics such that in the succeeding pull amount after the initial pull amount, the pull-out force is constant regardless of the amount of pull-out.

11. The headphone according to claim 10, wherein said constant force spiral spring is arranged such that when the headphone unit is attached to the hanger member, the constant force spiral spring has the constant pulled-out force beyond the initial pull amount.

12. The headphone according to claim 1, wherein the constant force spiral spring has an initial pull amount and a succeeding pull amount after the initial pull amount, and also has characteristics such that in the succeeding pull amount after the initial pull amount, the pull-out force is constant regardless of the amount of pull-out.

13. The headphone according to claim 12, wherein said constant force spiral spring is arranged such that when the headphone unit is attached to the hanger member, the constant force spiral spring has the constant pulled-out force beyond the initial pull amount.

* * * * *